US005970862A

United States Patent [19]

Ödmark

[11] Patent Number: 5,970,862

[45] Date of Patent: Oct. 26, 1999

[54] SEAL IN A ROLL PRESS

[75] Inventor: Leif Ödmark, Matfors, Sweden

[73] Assignee: Sunds Defibrator Industries AB, Sweden

[21] Appl. No.: 09/090,292

[22] Filed: Jun. 4, 1998

[30] Foreign Application Priority Data

Jun. 9, 1997 [SE] Sweden ..... 9702196

[51] Int. Cl.[6] ..... B30B 9/20

[52] U.S. Cl. ..... 100/99; 100/121; 162/232; 162/302; 162/323

[58] Field of Search ..... 100/99, 121, 174; 162/232, 302, 323, 331

[56] References Cited

U.S. PATENT DOCUMENTS

| | | | |
|---|---|---|---|
| 2,308,031 | 1/1943 | Schmitz, Jr. | 100/121 |
| 2,444,466 | 7/1948 | Peterson | 162/323 |
| 2,807,998 | 10/1957 | Stephan | 100/121 |
| 3,772,144 | 11/1973 | Luthi et al. | 100/121 |
| 3,848,993 | 11/1974 | Hasiotis | 100/174 |
| 5,515,619 | 5/1996 | Kahl et al. . | |

FOREIGN PATENT DOCUMENTS

| | | | |
|---|---|---|---|
| 457955 | 3/1928 | Germany | 100/121 |
| 503 010 | 4/1995 | Sweden . | |
| 95/10658 | 4/1995 | WIPO . | |

*Primary Examiner*—Stephen F. Gerrity
*Attorney, Agent, or Firm*—Lerner, David, Littenberg, Krumholz & Mentlik, LLP

[57] ABSTRACT

Apparatus for sealing a roll press including a seal extending along at least one of a pair of press rolls, the seal including a resilient member extending from the vat in which the press rolls are disposed towards one of the press rolls and a wear member attached to the resilient member for contacting the outer shell surface of the vat press roll whereby the wear member can be replaced upon wearing down of same.

9 Claims, 2 Drawing Sheets

SEAL IN A ROLL PRESS

FIELD OF THE INVENTION

The present invention relates to a seal in a roll press equipped with two interacting press rolls used to dewater stock suspensions.

BACKGROUND OF THE INVENTION

A roll press includes two interacting press rolls which form a nip between them. The rolls are generally arranged in a vat into which the stock suspension, such as a pulp suspension, is introduced. The rolls are designed so that their shell surfaces allow water to pass through, thereby dewatering the suspension due to the fact that the liquid is pressed in through these surfaces by a positive pressure. In the nip between the press rolls, final dewatering takes place in order to provide the desired dry-solids content of the stock. The shell surfaces of the press rolls consist of perforated plating attached to the roll frameworks. In order to obtain sufficient capacity, the total area of the open holes in the plating must be large, but the holes also must be kept small to prevent fibers from following along with the liquid as it passes through the holes. To accomplish this when processing short fibers, the press roll is provided with a wire cloth outside the perforated shell plating. Press rolls clad with a wire cloth have proven to be especially advantageous for mechanical pulp, which contains large amounts of short fibers; i.e., fine stock. Compared with conventional plating, the wire cloth permits smaller amounts of fine stock to pass through.

The rolls partially submersed in the vat are arranged to rotate on two parallel shafts, such that the vat surrounds at least the lower half of the rolls. The stock suspension is introduced into the space between the rolls and the vat. This space is sealed off from the environment in such a way that a positive pressure can be maintained in the vat in order to facilitate dewatering. Seals are herewith provided at the upper edge of the vat, and they seal against the ends of the rolls and also along the shell surfaces of the rolls. Such seals are described, for example, in Swedish Patent No. 503,010. Between the rolls, the nip itself and the pulp web that passes continuously through it serve as a seal against the environment. Doctor blades are also provided downstream of the nip to remove the dewatered pulp web from the rolls. Thereafter, the pulp is carried away by means of a conveyor to the next step in the process.

Experience has shown that the type of seal used in the past, which extends longitudinally along the shell surface of the roll, wears out too rapidly. This seal, which consists of a single piece of bent sheet steel, is also disadvantageous because if one increases the wear strength of the sheet steel, the stiffness of they spring changes. In addition, the sheet steel becomes more difficult to bend when it in made harder in order to reduce wear. In the event that the seal breaks down, not only must operation be stopped but the machine wire may be cut off and this, in turn, can ruin large amounts of pulp. The purpose of the present invention is to solve the aforesaid problems.

SUMMARY OF THE INVENTION

In accordance with the present invention, these and other objects have been accomplished by the invention of apparatus for sealing a roll press for dewatering a stock suspension comprising first and second press rolls including outer shell surfaces juxtaposed with each other so as to create a nip region therebetween, and a vat surrounding at least a portion of the first and second press rolls whereby the stock suspension to be dewatered between the first and second press rolls can be fed from the vat to the nip region, the apparatus comprising a seal extending along at least one of the first and second press rolls, the seal comprising a resilient member extending from the vat towards the at least one of the first and second press rolls and a wear member attached to the resilient member for contacting the outer shell surface of the at least one of the first and second press rolls, whereby the wear meter may be replaced upon wearing down of the wear member. Preferably, the wear member comprises plastic.

In accordance with one embodiment of the apparatus of the present invention, the seal comprises a first seal, and the apparatus includes a second seal extending along the other of the first and second press rolls, the second seal comprising a second resilient member extending from the vat towards the other of the first and second press rolls, and a second wear member attached to the second resilient member for contacting the outer shell surface of the other of the first and second press rolls whereby the second wear member can be replaced upon wearing down of the second wear member.

In accordance with another embodiment of the apparatus of the present invention, the apparatus includes an attachment member for attaching the wear member to the resilient member. In a preferred embodiment, the attachment member comprises a shaped attachment member, the wear member including a corresponding shaped surface whereby a joint is effected between the shaped attachment member and the wear member by placing the shaped attachment member into correspondence with the corresponding shaped surface of the wear member, and including a screw member for attaching the shaped attachment member to the resilient member. Preferably, the shaped attachment member has a generally T-shaped configuration and the corresponding shaped surface of the wear member is also generally T-shaped.

In accordance with another embodiment of the apparatus of the present invention, the apparatus includes a wear warning member associated with the wear member, whereby upon wearing down of the wear member to a predetermined extent, the warning member produces a warning signal. In a preferred embodiment, the warning member comprises first and second electrical leads mounted within the wear member at a distance from the surface of the wear member contacting the outer shell surface of the at least one of the first and second press rolls, the distance corresponding to the predetermined extent of wear of the wear member. Preferably, the apparatus includes a voltage source attached to one of the pair of electrical leads and a warning lamp attached to the other of the pair of electrical leads. In this manner, a seal designed in accordance with the present invention makes it possible to monitor seal wear continuously and advantageously by means of a wear indicator.

BRIEF DESCRIPTION OF THE DRAWINGS

The present invention may be more fully appreciated with reference to the following detailed description, which, in turn, refers to the drawings in which.

DETAILED DESCRIPTION

Figure 1:
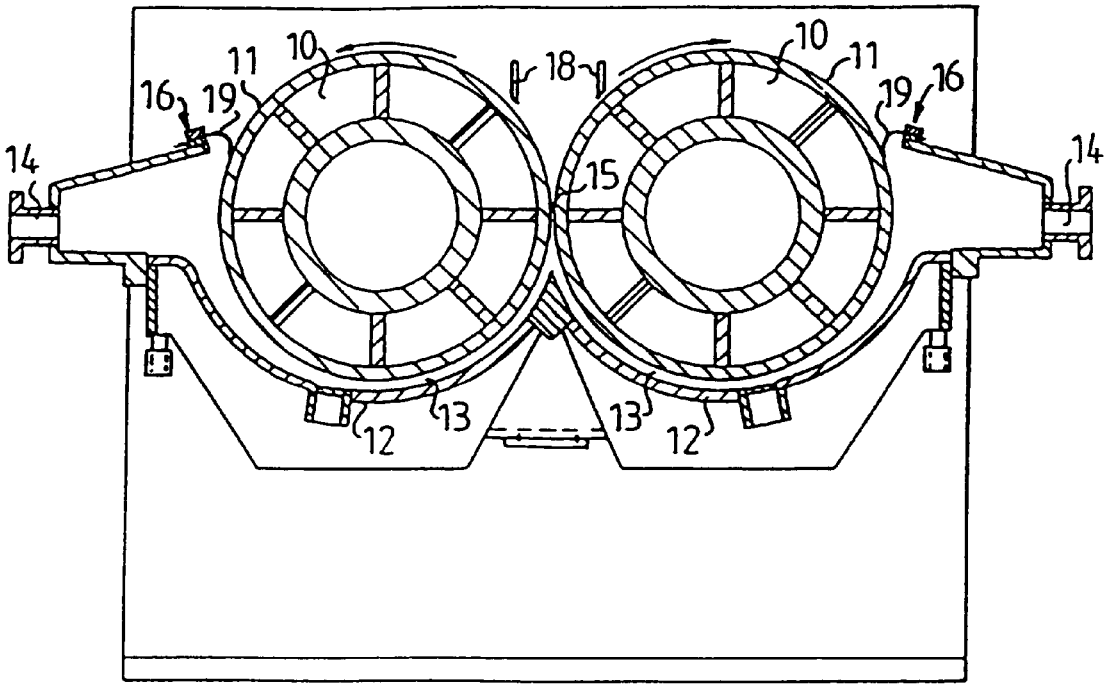
FIG. 1 is a side, elevational, cross-sectional view of a roll press.
Figure 2:
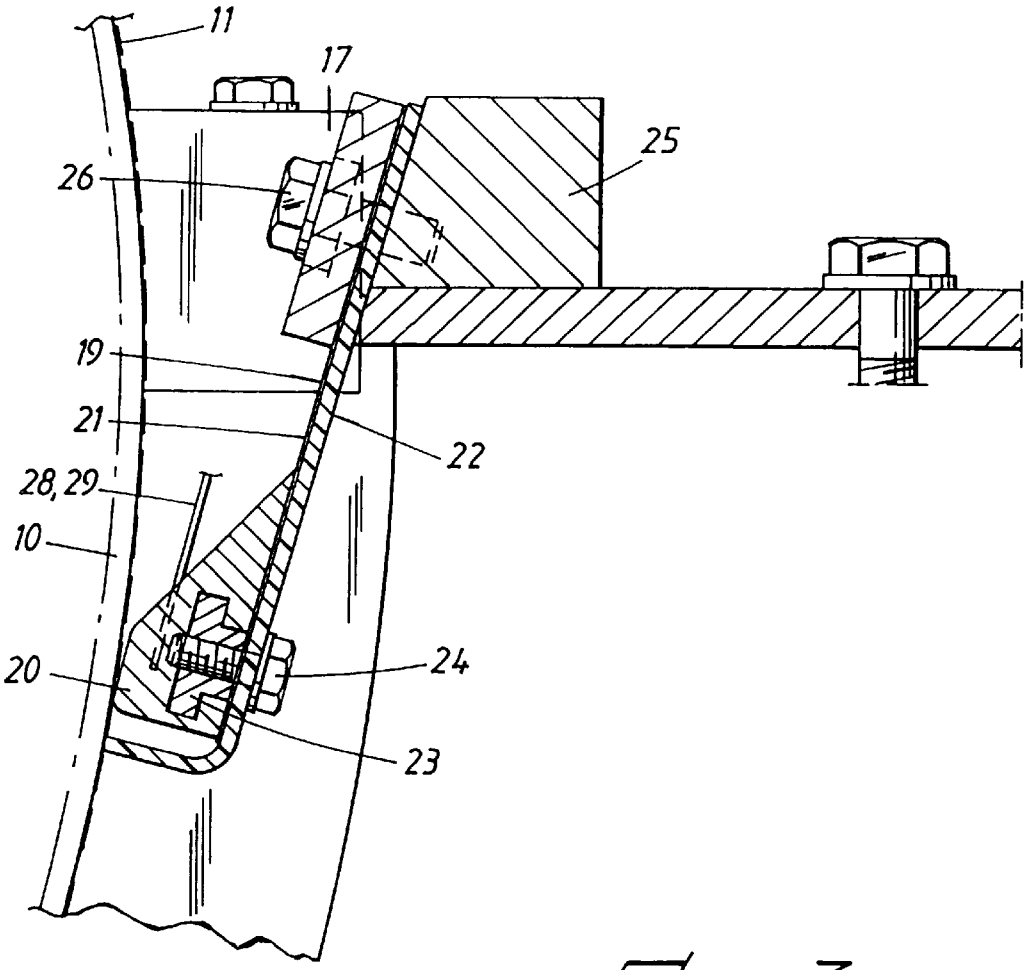
FIG. 2 is a partial, side, elevational, cross-sectional view of a seal for a roll press in accordance with the present invention.
Figure 3:
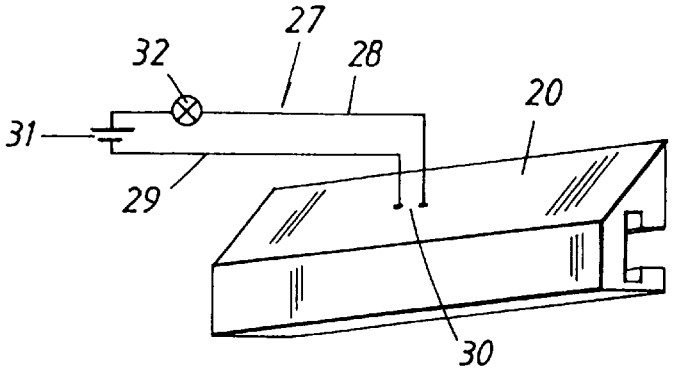
FIG. 3 is a schematic representation of the wear portion of a seal in accordance with the present invention.

Referring to the Figures, in which like reference numerals refer to like elements thereof, the roll press shown in FIG.

1 includes two cylindrical, rotatable press rolls, 10, through which water can pass, and having shell surfaces made of perforated plating which is welded to the roll frameworks. A wire cloth 11 is provided on the outside of the perforated platings, said wire cloth being made, if appropriate, of plastic strands. Press rolls 10 are partially submersed in vat 12 in such a way that spaces 13 are formed between the rolls and the inside surface of the vat. These spaces 13 communicate with pulp suspension inlet 14. Roll nip 15 is formed between the press rolls 10. Spaces 13 are sealed off from the environment by means of seals 16 which seal against the shell surfaces of rolls 10 and also seals 17 which press against the ends of the rolls. Between the rolls, the pulp web in nip 15 serves as a seal. Downstream from nip 15, doctors 18 are provided to remove from the shell surfaces of the rolls the pulp web that comes from nip 15.

Seal 16 between vat 12 and the shell surface 10 of each of the rolls extends along the entire length of each roll and consists, in accordance with the present invention, of a spring part 19 and a wear part 20. The spring part 19 consists of a spring plate 31 and a rubber element 22 which is in contact with the surface of the spring plate that faces away from the roll. Wear part 20 is made, if appropriate, of plastic. It is attached to spring part 19 by means of a T-shaped part 23 that is screwed into the spring part. T-shaped part 23 is attached to wear part 20 by means of a joint effected by the shape of the parts and is joined to spring part 19 by means of screw 24. Spring part 19 is screwed to cover plate 25 on vat 12 by means of screws 26.

Because the wear part of the seal is separate from the spring part, the shape of the wear part and the material from which it is made can be optimized without changing the stiffness of the spring part. Because of the way in which the spring part is attached, spring plate 21 does not have to be bent, and this facilitates design and construction, and reduces costs. Wear part 20 is the only part that requires replacement. Because the wear part of the seal designed in accordance with the present invention is made of plastic, it can also replace seals used on a roll shell that has no wire cloth, thereby making it easier and less expensive to add or remove the wire cloth which, of course, is only required when there are short fibers in the pulp suspension. The seal designed in accordance with the present invention also conforms better with the roll, and is thus better able to return fibers that have slipped past the doctor blade and continue to move along the roll shell. Moreover, the seal permits the roll to be backed up; i.e., rotated in the reverse direction, and because of its geometry the seal also provides greater resistance to vat pressure peaks.

The seal designed in accordance with the present invention also makes it possible to provide a novel wear indicator which issuer a warning signal when wear part 20 have been worn down to a certain dimensions at which replacement is necessary. In accordance with the present invention, wear indicator 27 comprises two electrical leads, 28 and 29, which are mounted inside wear part 20 at a distance form the surface that contacts roll 10 which matches the permissible wear allowance of the wear part. These lead, 28 and 29, are spaced a distance 30 apart in the axial direction of the roll. Voltage source 31 and warning lamp 32 are connected to leads, 28 and 29. When wear part 20 is worn down to the level of the ends of leads, 28 and 29, they are connected electrically by the water in the pulp suspension, whereupon warning lamp 31 is lighted to indicate that it is time to replace wear part 20.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

I claim:

1. Apparatus for sealing a roll press for dewatering a stock suspension comprising first and second press rolls including outer shell surfaces juxtaposed with each other so as to create a nip region therebetween, and a vat surrounding at least a portion of said first and second press rolls whereby said stock suspension to be dewatered between said first and second press rolls can be fed from said vat to said nip region, said apparatus comprising a seal extending along at least one of said first and second press rolls, said seal comprising a resilient member extending from said vat toward said at least one of said first and second press rolls and a wear member attached to said resilient member for contacting said outer shell surface of said at least one of said first and second press rolls whereby said wear member may be replaced upon wearing down of said wear member.

2. The apparatus of claim 1 wherein said wear member comprises plastic.

3. The apparatus of claim 1 wherein said seal comprises a first seal, and including a second seal extending along said other of said first and second press rolls, said second seal comprising a second resilient member extending from said vat towards said other of said first and second press rolls, and a second wear member attached to said second resilient member for contacting said outer shell surface of said other of said first and second press rolls whereby said second wear member can be replaced upon wearing down of said second wear member.

4. The apparatus of claim 1 including an attachment member for attaching said wear member to said resilient member.

5. The apparatus of claim 4 wherein said attachment member comprises a shaped attachment member, said wear member including a corresponding shaped surface whereby a joint is effected between said shaped attachment member and said wear member by placing said shaped attachment member into correspondence with said corresponding shaped surface of said wear member, and including a screw member for attaching said shaped attachment member to said resilient member.

6. The apparatus of claim 5 wherein said shaped attachment member has a generally T-shaped configuration, and said corresponding shaped surface of said wear member is also generally T-shaped.

7. The apparatus of claim 1 including a warning member associated with said wear member, whereby upon wearing down of said wear member to a predetermined extent said warning member produces a warning signal.

8. The apparatus of claim 7 wherein said is warning member comprises first and second electrical leads mounted within said wear member at a distance from the surface of said wear member contacting said outer shell surface of said at least one of said first and second press rolls, said distance corresponding to said predetermined extent of wear of said wear member.

9. The apparatus of claim 8 including a voltage source attached to one of said pair of electrical leads and a warning lamp attached to the other of said pair of electrical leads.

* * * * *

UNITED STATES PATENT AND TRADEMARK OFFICE

CERTIFICATE OF CORRECTION

PATENT NO. : 5,970,862

DATED : October 26, 1999

INVENTOR(S) : Leif Ödmark

It is certified that error appears in the above-identified patent and that said Letters Patent is hereby corrected as shown below:

Column 1, line 52, "they" should read --the--.
Column 1, line 53, "in" should read --is--.
Column 2, line 10, "meter" should read --member--.
Column 3, line 52, "issuer" should read --issues--.
Column 4, line 56, cancel the word "is".

Signed and Sealed this

Twentieth Day of June, 2000

*Attest:*

*Attesting Officer*

Q. TODD DICKINSON

*Director of Patents and Trademarks*